US007737105B2

(12) United States Patent
Delplancke et al.

(10) Patent No.: US 7,737,105 B2
(45) **Date of Patent: *Jun. 15, 2010**

(54) FABRIC TREATMENT COMPOSITIONS COMPRISING OPPOSITELY CHARGED POLYMERS

(75) Inventors: Patrick Firmin August Delplancke, Laarne (BE); Jean-Pol Boutique, Gembloux (BE); Roland Wagner, Bonn (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/716,962

(22) Filed: Mar. 12, 2007

(65) Prior Publication Data

US 2007/0163055 A1 Jul. 19, 2007

Related U.S. Application Data

(62) Division of application No. 10/700,811, filed on Nov. 4, 2003, now Pat. No. 7,205,270.

(60) Provisional application No. 60/423,483, filed on Nov. 4, 2002.

(51) Int. Cl.

| | |
|---|---|
| ***C11D 9/36*** | (2006.01) |
| ***C11D 9/30*** | (2006.01) |
| ***C11D 3/30*** | (2006.01) |
| ***C11D 3/37*** | (2006.01) |

(52) U.S. Cl. ..... 510/466; 510/276; 510/308; 510/329; 510/330; 510/341; 510/470; 510/504; 510/515; 510/516

(58) Field of Classification Search ..... 510/276, 510/308, 329, 330, 341, 466, 470, 504, 515, 510/516

See application file for complete search history.

(56) References Cited

U.S. PATENT DOCUMENTS

| | | | | |
|---|---|---|---|---|
| 4,364,837 | A | 12/1982 | Pader | |
| 4,371,517 | A | 2/1983 | Dubief et al. | |
| 4,661,267 | A | 4/1987 | Dekker et al. | |
| 4,818,242 | A | 4/1989 | Burmeister et al. | |
| 4,960,845 | A | 10/1990 | O'Lenick, Jr. et al. | |
| 5,080,312 | A | 1/1992 | Ebey | |
| 5,085,857 | A | 2/1992 | Reid et al. | |
| 5,276,979 | A | 1/1994 | Gordon, Sr. | |
| 5,296,625 | A | 3/1994 | O'Lenick, Jr. et al. | |
| 5,580,494 | A | 12/1996 | Sandhu et al. | |
| 6,134,810 | A | 10/2000 | Stockley | |
| 6,136,215 | A | 10/2000 | Evans et al. | |
| 6,277,361 | B1 | 8/2001 | Murray | |
| 6,355,234 | B1 | 3/2002 | Birtwistle et al. | |
| 6,451,747 | B1 | 9/2002 | Decoster | |
| 6,833,344 | B2 | 12/2004 | Boutique et al. | |
| 6,903,061 | B2 * | 6/2005 | Masschelein et al. | 510/330 |
| 7,205,270 | B2 * | 4/2007 | Delplancke et al. | 510/466 |
| 7,273,837 | B2 | 9/2007 | Boutique et al. | |
| 2002/0068689 | A1 * | 6/2002 | Fender et al. | 510/511 |
| 2002/0103094 | A1 | 8/2002 | Masschelein et al. | |
| 2005/0164900 | A1 | 7/2005 | Masschelein et al. | |

FOREIGN PATENT DOCUMENTS

| | | | |
|---|---|---|---|
| CA | 2320500 | | 3/2001 |
| EP | 0 422 787 | | 4/1991 |
| EP | 0 468 721 | A | 1/1992 |
| EP | 0 530 974 | A | 3/1993 |
| EP | 0 811 051 | B1 | 12/1997 |
| EP | 0 989 226 | | 3/1999 |
| EP | 0 971 025 | A | 1/2000 |
| EP | 1 058 530 | B1 | 12/2000 |
| FR | 2 353 633 | A | 10/1980 |
| JP | 10211390 | | 8/1998 |
| WO | WO 99/44567 | | 9/1999 |
| WO | WO 00/24853 | | 5/2000 |
| WO | WO 00/24857 | | 5/2000 |
| WO | WO 00/70005 | A1 | 11/2000 |
| WO | WO 00/71806 | A1 | 11/2000 |
| WO | WO 01/25386 | A1 | 4/2001 |
| WO | WO 01/25387 | A1 | 4/2001 |
| WO | WO 02/10259 | A1 | 2/2002 |
| WO | WO 02/18528 | * | 3/2002 |
| WO | WO 02/36095 | A2 | 5/2002 |
| WO | WO 03/101411 | A1 | 12/2003 |

OTHER PUBLICATIONS

U.S. Appl. No. 11/818,650, filed Jun. 15, 2007, Boutique, et al.

* cited by examiner

*Primary Examiner*—Brian P Mruk
(74) *Attorney, Agent, or Firm*—Armina E. Matthews; Leonard W. Lewis

(57) ABSTRACT

The invention is directed to fabric treatment compositions comprising at least one cationic polymer and at least one anionic polymer, wherein at least one of these two polymers is a silicone polymer, and wherein said composition forms a coacervate phase.

4 Claims, No Drawings

FABRIC TREATMENT COMPOSITIONS COMPRISING OPPOSITELY CHARGED POLYMERS

CROSS REFERENCE TO RELATED APPLICATIONS

This application is a Divisional of U.S. patent Ser. No. 10/700,811, now U.S. Pat. No. 7,205,270, filed Nov. 4, 2003; which claims the benefit of U.S. Provisional Application Ser. No. 60/423,483, filed Nov. 4, 2002.

FIELD OF THE INVENTION

This invention relates to fabric treatment compositions. The invention also relates to methods for treating fabrics in fabric treatment applications including domestic laundering to thereby provide improved fabric care.

BACKGROUND OF THE INVENTION

When consumers launder fabrics, they desire not only excellence in cleaning, they also seek superior to impart superior fabric care benefits. Such care can be exemplified by one or more of reduction of wrinkles benefits; removal of wrinkles benefits; prevention of wrinkles benefits; fabric softness benefits; fabric feel benefits; garment shape retention benefits; garment shape recovery benefits; elasticity benefits; ease of ironing benefits; perfume benefits; color care benefits; or any combination thereof.

Compositions which can provide fabric care benefits during laundering operations are known, for example in form of rinse-added fabric softening compositions. Compositions which can provide both cleaning and fabric care benefits, e.g., fabric softening benefits, at the same time, are also known, for example in the form of "2-in-1" compositions and/or "softening through the wash" compositions.

In laundering, there exist unique and significant challenges for securing fabric care. WO 01/25 387 A1 (Unilever, published Apr. 12, 2001) describes fabric care compositions comprising a cross-linkable anionic polymer and a fabric conditioning agent acting as a textile compatible exhausting agent for the anionic polymer. The compositions deliver increased dimensional stability of the fabric, improved surface colour definition, softer handle and improved crease recovery. WO 01/25 386 A1 (Unilever, published Apr. 12, 2001) discloses surface laundry detergent compositions comprising a wrinkle reduction agent selected of among others from aminopolydimethyl-siloxane polyalkyleneoxide copolymers. In spite of the advances in the art, there remains a need for improved fabric care. In particular, there remain important unsolved problems with respect to selecting compatible fabric care ingredients so that the combination of more than one fabric care ingredient provides uncompromising levels of fabric care. Furthermore, when the composition is a laundry detergent composition, it remains particularly difficult to combine anionic surfactants and cationic fabric care beneficial agents in such a way as to secure superior fabric care at the same time as outstanding cleaning and formulation stability or flexibility.

Accordingly, objects of the present invention include to solve the hereinabove mentioned technical problems and to provide compositions and methods having specifically selected cationic fabric care agents and optionally other adjuncts that secure superior fabric care.

One embodiment of the present invention is a fabric treatment composition comprising at least two oppositely charged polymers, one cationic polymer and one anionic polymer. At least one of these at least two polymers is a silicone polymer.

Considering compositions with only two polymers, the following combinations are possible: a composition wherein the anionic polymer is a silicone polymer and wherein the cationic polymer is a non-silicone-containing polymer, and a composition wherein the cationic polymer is a silicone polymer and wherein the anionic polymer is a non-silicone-containing polymer. However, compositions, in which the cationic polymer is a silicone polymer and in which the anionic polymer is also a silicone polymer are also included. The fabric treatment compositions of the present invention form a coacervate phase. The combination of the above-cited oppositely charged polymers provides superior fabric care in home laundering.

The present invention imparts superior fabric care and/or garment care as exemplified above. Moreover the invention has other advantages, depending on the precise embodiment, which include superior formulation flexibility and/or formulation stability of the home laundry compositions provided.

It has surprisingly been found that, given proper attention both to the selection of the cationic polymer as well as of the anionic polymer, unexpectedly good fabric care and/or consumer acceptance of the home laundry product are obtained. Moreover, superior fabric care or garment care benefits in home laundering as discovered in the present invention unexpectedly include benefits when the products herein are used in different modes, such as treatment before washing in an automatic washing machine (pretreatment benefits), through the wash benefits, and post-treatment benefits, including benefits secured when the inventive products are used in the rinse or in fabric or garment spin-out or drying in, or outside an appliance. Additionally discovered are regimen benefits, i.e., benefits of converting from use of a product system comprising conventional detergents to a product system comprising use of the present inventive compositions and compositions formulated specifically for use therewith.

For one embodiment of the present invention, it has been found that the combination of a specific cationic silicone polymer and an anionic non-silicone-containing polymer provides synergistic effects for fabric care. In a second embodiment of the present invention, it has been found that the combination of a specific anionic silicone polymer and a cationic non-silicone-containing polymer provides synergistic effects for fabric care. In a third embodiment of the present invention, it has been found that the combination of a specific cationic silicone polymer and an anionic silicone polymer provides synergistic effects for fabric care.

SUMMARY OF THE INVENTION

The present invention relates to a fabric treatment composition comprising at least one cationic polymer and at least one anionic polymer, wherein at least one of these two polymers is a silicone polymer, and wherein the composition forms a coacervate phase.

The invention further includes the use of a fabric treatment composition of the present invention to impart fabric care benefits and/or reduce and/or prevent wrinkles and/or impart fabric feel benefits and/or shape retention benefits and/or shape recovery and/or elasticity and/or ease of ironing benefits and/or perfume benefits and/or cleaning benefits on a fabric substrate.

The present invention further describes a method for treating a substrate. This method includes contacting the substrate with the fabric treatment composition or with the liquid laundry detergent composition or with a rinse-added fabric softening composition or with a fabric finishing composition of the present invention such that the substrate is treated.

DETAILED DESCRIPTION OF THE INVENTION

A, Cationic silicone polymer—The cationic silicone polymer selected for use in the present invention compositions comprises one or more polysiloxane units, preferably polydimethylsiloxane units of formula —$\{(CH_3)_2SiO\}_c$— having a degree of polymerization, c, of from 50 to 1000, preferably of from 50 to 500, more preferably of from 50 to 200 and organosilicone-free units comprising at least one diquaternary unit. In a preferred embodiment of the present invention, the selected cationic silicone polymer has from 0.05 to 1.0 mole fraction, more preferably from 0.2 to 0.95 mole fraction, most preferably 0.5 to 0.9 mole fraction of the organosilicone-free units selected from cationic divalent organic moieties. The cationic divalent organic moiety is preferably selected from N,N,N',N'-tetramethyl-1,6-hexanediammonium units.

The selected cationic silicone polymer can also contain from 0 to 0.95 mole fraction, preferably from 0.001 to 0.5 mole fraction, more preferably from 0.05 to 0.2 mole fraction of the total of organosilicone-free units, polyalkyleneoxide amines of the following formula:

$$[—Y—O(—C_aH_{2a}O)_b—Y—]$$

wherein Y is a divalent organic group comprising a secondary or tertiary amine, preferably a $C_1$ to $C_8$ alkylenamine residue; a is from 2 to 4, and b is from 0 to 100. The polyalkyleneoxide blocks may be made up of ethylene oxide (a=2), propylene oxide (a=3), butylene oxide (a=4) and mixtures thereof, in a random or block fashion.

Such polyalkyleneoxide amine—containing units can be obtained by introducing in the silicone polymer structure, compounds such as those sold under the tradename Jeffamine® from Huntsman Corporation. A preferred Jeffamine is Jeffamine ED-2003.

The selected cationic silicone polymer can also contain from 0, preferably from 0.001 to 0.2 mole fraction, of the total of organosilicone-free units, of —$NR_3$+ wherein R is alkyl, hydroxyalkyl or phenyl. These units can be thought of as end-caps.

Moreover the selected cationic silicone polymer generally contains anions, selected from inorganic and organic anions, more preferably selected from saturated and unsaturated $C_1$-$C_{20}$ carboxylates and mixtures thereof, to balance the charge of the quaternary moieties, thus the cationic silicone polymer also comprises such anions in a quaternary charge-balancing proportion.

Conceptually, the selected cationic silicone polymers herein can helpfully be thought of as non-crosslinked or "linear" block copolymers including non-fabric-substantive but surface energy modifying "loops" made up of the polysiloxane units, and fabric-substantive "hooks". One preferred class of the selected cationic polymers (illustrated by Structure 1 hereinafter) can be thought of as comprising a single loop and two hooks; another, very highly preferred, comprises two or more, preferably three or more "loops" and two or more, preferably three or more "hooks" (illustrated by Structures 2a and 2b hereinafter), and yet another (illustrated by Structure 3 hereinafter) comprises two "loops" pendant from a single "hook".

Of particular interest in the present selection of cationic silicone polymers is that the "hooks" contain no silicone and that each "hook" comprises at least two quaternary nitrogen atoms.

Also of interest in the present selection of preferred cationic silicone polymers is that the quaternary nitrogen is preferentially located in the "backbone" of the "linear" polymer, in contradistinction from alternate and less preferred structures in which the quaternary nitrogen is incorporated into a moiety or moieties which form a "pendant" or "dangling" structure off the "backbone".

The structures are completed by terminal moieties which can be noncharged or charged. Moreover a certain proportion of nonquaternary silicone-free moieties can be present, for example the moiety $[—Y—O(—C_aH_{2a}O)_b—Y—]$ as described hereinabove.

Of course the conceptual model presented is not intended to be limiting of other moieties, for example connector moieties, which can be present in the selected cationic silicone polymers provided that they do not substantially disrupt the intended function as fabric benefit agents.

In more detail, the cationic silicone polymers herein have one or more polysiloxane units and one or more quaternary nitrogen moieties, including polymers wherein the cationic silicone polymer has the formula: (Structure 1)

STRUCTURE 1

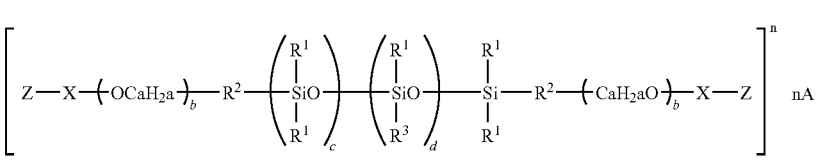

wherein:

$R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms (such moieties preferably consist essentially of C and H or of C, H and O);

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide or (poly)alkoxy alkyl;

Z is independently selected from the group consisting of monovalent organic moieties comprising at least one quaternized nitrogen atom;

a is from 2 to 4; b is from 0 to 100; c is from 1 to 1000, preferably greater than 20, more preferably greater than 50, preferably less than 500, more preferably less than 300, most preferably from 100 to 200; d is from 0 to 100; n is the number of positive charges associated with the cationic silicone polymer, which is greater than or equal to 2; and A is a monovalent anion.

In a preferred embodiment of the Structure 1 cationic silicone polymers, Z is independently selected from the group consisting of:

(i) 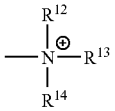

(ii) 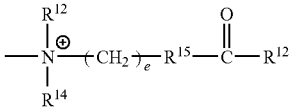

(iii) 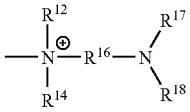

(iv) 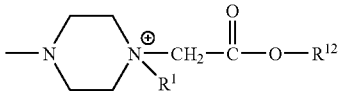

(v) monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl and mixtures thereof; and e is from 1 to 6.

In a highly preferred embodiment, the cationic silicone polymers herein have one or more polysiloxane units and one or more quaternary nitrogen moieties, including polymers wherein the cationic silicone polymer has the formula: (Structure 2a)

Structure 2a: Cationic Silicone Polymer Composed of Alternating Units of:

(i) a polysiloxane of the following formula

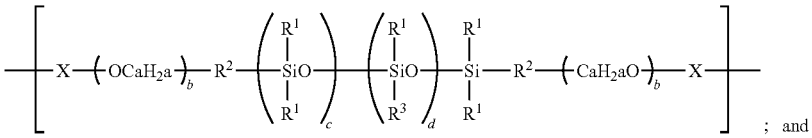

; and (ii) a divalent organic moiety comprising at least two quaternized nitrogen atoms.

Note that Structure 2a comprises the alternating combination of both the polysiloxane of the depicted formula and the divalent organic moiety, and that the divalent organic moiety is organosilicone-free corresponding to a preferred "hook" in the above description.

In this preferred cationic silicone polymer, $R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl; a is from 2 to 4; b is from 0 to 100; c is from 1 to 1000, preferably greater than 20, more preferably greater than 50, preferably less than 500, more preferably less than 300, most preferably from 100 to 200; and d is from 0 to 100.

In an even more highly preferred embodiment of the Structure 2a cationic silicone polymer, the cationic silicone polymer has the formula Structure 2b wherein the polysiloxane (i) of the formula described above as Structure 2a is present with (ii) a cationic divalent organic moiety selected from the group consisting of:

(a) 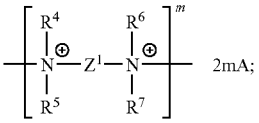 2mA;

(b) 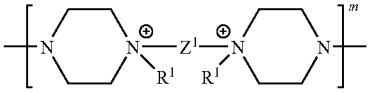 2mA;

(c) 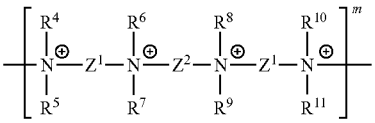 4mA;

(d) a divalent aromatic or aliphatic heterocyclic group, substituted or unsubstituted, containing at least one quaternized nitrogent atom; and (iii) optionally, a polyalkyleneoxide amine of formula:

$$[—Y—O(—C_aH_{2a}O)_b—Y—]$$

Y is a divalent organic group comprising a secondary or tertiary amine, preferably a $C_1$ to $C_8$ alkylenamine residue; a is from 2 to 4; b is from 0 to 100. The polyalkyleneoxide blocks may be made up of ethylene oxide (a=2), propylene oxide (a=3), butylene oxide (a=4) and mixtures thereof, in a random or block fashion; and (iv) optionally, a cationic monovalent organic moiety, to be used as an end-group, selected from the group consisting of:

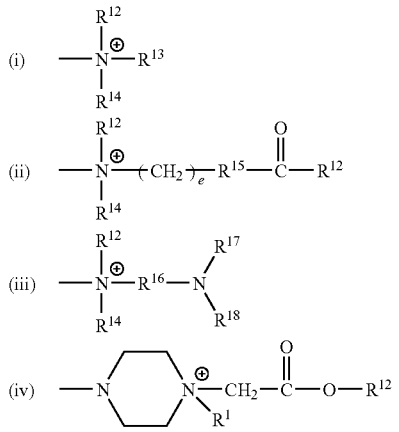

(v) monovalent aromatic or aliphatic heterocyclic group, substituted or unsubstituted, containing at least one quaternized nitrogen atom;

wherein:

$R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof; or in which $R^4$ and $R^6$, or $R^5$ and $R^7$, or $R^8$ and $R^{10}$, or $R^9$ and $R^{11}$ may be components of a bridging alkylene group;

$R^{12}$, $R^{13}$, $R^{14}$ are the same or different, and are selected from the group consisting of: $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof; and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms, optionally containing a hydroxy group, and which may be interrupted by one or several ether, ester or amide groups;

wherein, expressed as fractions on the total moles of the organosilicone-free moieties, the cationic divalent organic moiety (ii) is preferably present at of from 0.05 to 1.0 mole fraction, more preferably of from 0.2 to 0.95 mole fraction, and most preferably of from 0.5 to 0.9 mole fraction; the polyalkyleneoxide amine (iii) can be present of from 0.0 to 0.95 mole fraction, preferably of from 0.001 to 0.5, and more preferably of from 0.05 to 0.2 mole fraction; if present, the cationic monovalent organic moiety (iv) is present of from 0 to 0.2 mole fraction, preferably of from 0.001 to 0.2 mole fraction;

e is from 1-6; m is the number of positive charges associated with the cationic divalent organic moiety, which is greater than or equal to 2; and A is an anion.

Note that Structure 2b comprises the alternating combination of both the polysiloxane of the depicted formula and the divalent organic moiety, and that the divalent organic moiety is organosilicone-free corresponding to a preferred "hook" in the above general description. Structure 2b moreover includes embodiments in which the optional polyalkyleneoxy and/or end group moieties are either present or absent.

In yet another embodiment, the cationic silicone polymers herein have one or more polysiloxane units and one or more quaternary nitrogen moieties, and including polymers wherein the cationic silicone polymer has the formula: (Structure 3)

STRUCTURE 3

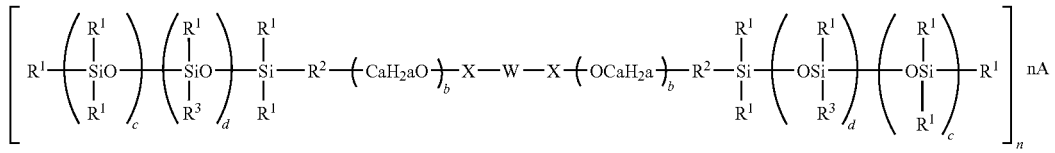

wherein:

$R^1$ is independently selected from the group consisting of: $C_{1-22}$ alkyl; $C_{2-22}$ alkenyl; $C_{6-22}$ alkylaryl; aryl; cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

X is independently selected from the group consisting of ring-opened epoxides;

W is independently selected from the group consisting of divalent organic moieties comprising at least one quaternized nitrogen atom a is from 2 to 4; b is from 0 to 100; c is from 1 to 1000, preferably greater than 20, more preferably greater than 50, preferably less than 500, more preferably less than 300, most preferably from 100 to 200; d is from 0 to 100; n is the number of positive charges associated with the cationic silicone polymer, which is greater than or equal to 1; and A is a monovalent anion, in other words, a suitable couterion.

In preferred cationic silicone polymers of Structure 3, W is selected from the group consisting of:

(a) 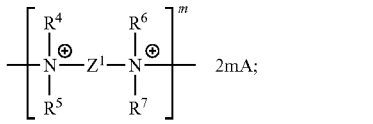 2mA;

(b) 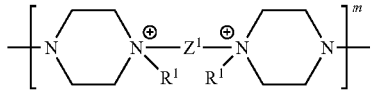 2mA;

(c) 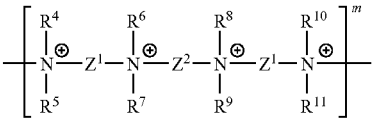 4mA;

(d) a divalent aromatic or aliphatic heterocyclic group, substituted or unsubstituted, containing at least one quaternized nitrogent atom; and $R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group; and $Z^1$ and $Z^2$ are the same or different divalent hydrocarbon groups with at least 2 carbon atoms, optionally containing a hydroxy group, and which may be interrupted by one or several ether, ester or amide groups.

Reference is made to the following patents and patent applications which do also disclose cationic silicone polymers suitable for use in the present invention: WO 02/06 403; WO 02/18 528, EP 1 199 350; DE OS 100 36 533; WO 00/24 853; WO 02/10 259; WO 02/10 257 and WO 02/10 256. If present, the cationic silicone-containing polymer is typically present at levels in the range of from 0.001% to 50%, preferably at least from 0.01% to 30%, more preferably from 0.1% to 10%, and most preferably from 0.2% to 5% by weight of the composition.

SYNTHESIS EXAMPLE

When not otherwise known or available in commerce, the cationic silicone polymers herein can be prepared by conventional techniques as disclosed in WO 02/18 528.

B, Anionic Silicone-containing Polymer—The anionic polymer is selected from the group consisting of silicones comprising at least one carboxylate, sulfate, sulfonate, phosphate or phosphonate group and derivatives thereof and mixtures thereof. If present, the anionic silicone-containing polymer is typically present at levels in the range of from 0.001% to 50%, preferably at least from 0.01% to 30%, more preferably from 0.1% to 10%, and most preferably from 0.2% to 5% by weight of the composition. Most preferred anionic silicone-containing polymers are those commercially available from BASF, sold under the tradename of Densodrin® OF and Densodrin® SI; from Osi/Crompton, sold under the tradename of FZ-3703®; from Toray/Dow Corning Silicones, sold under the tradename of BY 16-750® and BY 16-880®; from Noveon/BF Goodrich, sold under the tradename of Ultrasil® CA-1; from Shin Etsu, sold under the tradename of X22-3701E® and from Wacker, sold under the tradename of M-642®.

C, Cationic Non-Silicone-containing Polymer—If present, the cationic non-silicone-containing polymer is typically present at levels in the range of from 0.01% to 10%, preferably at least from 0.05% to 5%, more preferably from 0.1% to 2.0% by weight of the composition.

Preferred cationic polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8. The average molecular weight of such suitable cationic polymers will generally be between 10,000 and 10 million, preferably between 50,000 and 5 million, more preferably between 100,000 and 3 million.

Suitable cationic polymers for use in the compositions of the present invention contain cationic nitrogen-containing moieties such as quaternary ammonium or cationic protonated amino moieties. The cationic protonated amines can be primary, secondary, or tertiary amines (preferably secondary or tertiary), depending upon the particular species and the selected pH of the composition. Any anionic counterions can be used in association with the cationic polymers so long as the polymers remain soluble in water, in the composition, or in a coacervate phase of the composition, and so long as the counterions are physically and chemically compatible with the essential components of the composition or do not otherwise unduly impair product performance, stability or aesthetics. Non-limiting examples of such counterions include halides (e.g., chloride, fluoride, bromide, iodide), sulfate and methylsulfate.

Non-limiting examples of such polymers are described in the CTFA Cosmetic Ingredient Dictionary, 3rd edition, edited by Estrin, Crosley, and Haynes, (The Cosmetic, Toiletry, and Fragrance Association, Inc., Washington, D.C. (1982)).

Non-limiting examples of suitable cationic polymers include copolymers of vinyl monomers having cationic protonated amine or quaternary ammonium functionalities with water soluble spacer monomers such as acrylamide, methacrylamide, alkyl and dialkyl acrylamides, alkyl and dialkyl methacrylamides, alkyl acrylate, alkyl methacrylate, vinyl caprolactone or vinyl pyrrolidone.

Suitable cationic protonated amino and quaternary ammonium monomers, for inclusion in the cationic polymers of the composition herein, include vinyl compounds substituted with dialkylaminoalkyl acrylate, dialkylaminoalkyl methacrylate, monoalkylaminoalkyl acrylate, monoalkylaminoalkyl methacrylate, trialkyl methacryloxyalkyl ammonium salt, trialkyl acryloxyalkyl ammonium salt, diallyl quaternary ammonium salts, and vinyl quaternary ammonium monomers having cyclic cationic nitrogen-containing rings such as pyridinium, imidazolium, and quaternized pyrrolidone, e.g., alkyl vinyl imidazolium, alkyl vinyl pyridinium, alkyl vinyl pyrrolidone salts.

Other suitable cationic polymers for use in the compositions include copolymers of 1-vinyl-2-pyrrolidone and 1-vinyl-3-methylimidazolium salt (e.g., chloride salt) (referred to in the industry by the Cosmetic, Toiletry, and Fragrance Association, "CTFA", as Polyquarternium-16); copolymers of 1-vinyl-2-pyrrolidone and dimethylaminoethyl methacrylate (referred to in the industry by CTFA as Polyquarternium-11); cationic diallyl quaternary ammonium-containing polymers, including, for example, dimethyldiallylammonium chloride homopolymer, copolymers of acrylamide and dimethyldiallylammonium chloride (referred to in the industry by CTFA as Polyquarternium 6 and Polyquarternium 7, respectively);

amphoteric copolymers of acrylic acid including copolymers of acrylic acid and dimethyldiallylammonium chloride (referred to in the industry by CTFA as Polyquarternium 22), terpolymers of acrylic acid with dimethyldiallylammonium chloride and acrylamide (referred to in the industry by CTFA as Polyquarternium 39), and terpolymers of acrylic acid with methacrylamidopropyl trimethylammonium chloride and methylacrylate (referred to in the industry by CTFA as Polyquarternium 47). Preferred cationic substituted monomers are the cationic substituted dialkylaminoalkyl acrylamides, dialkylaminoalkyl methacrylamides, and combinations thereof. These preferred monomers conform to the formula:

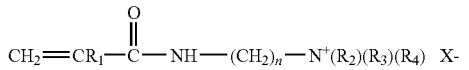

wherein $R^1$ is hydrogen, methyl or ethyl; each of $R^2$, $R^3$ and $R^4$ are independently hydrogen or a short chain alkyl having from 1 to 8 carbon atoms, preferably from 1 to 5 carbon atoms, more preferably from 1 to 2 carbon atoms; n is an integer having a value of from 1 to 8, preferably from 1 to 4; and X is a counterion. The nitrogen attached to $R^2$, $R^3$ and $R^4$ may be a protonated amine (primary, secondary or tertiary), but is preferably a quaternary ammonium wherein each of $R^2$, $R^3$ and $R^4$ are alkyl groups a non limiting example of which is polymethyacrylamidopropyl trimonium chloride, available under the trade name Polycare 133, from Rhone-Poulenc, Cranberry, N.J., U.S.A. Also preferred are copolymers of this cationic monomer with nonionic monomers such that the cationic charge density of the copolymer remains in the range specified above.

Other suitable cationic polymers for use in the composition include polysaccharide polymers, such as cationic cellulose derivatives and cationic starch derivatives. Suitable cationic polysaccharide polymers include those which conform to the formula:

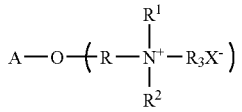

wherein A is an anhydroglucose residual group, such as a starch or cellulose anhydroglucose residual; R is an alkylene oxyalkylene, polyoxyalkylene, or hydroxyalkylene group, or combination thereof; $R^1$, $R^2$, and $R^3$ independently are alkyl, aryl, alkylaryl, arylalkyl, alkoxyalkyl, or alkoxyaryl groups, each group containing up to 18 carbon atoms, and the total number of carbon atoms for each cationic moiety (i.e., the sum of carbon atoms in $R^1$, $R^2$ and $R^3$) preferably being 20 or less; and X is an anionic counterion as described in hereinbefore.

Preferred cationic cellulose polymers are salts of hydroxyethyl cellulose reacted with trimethyl ammonium substituted epoxide, referred to in the industry (CTFA) as Polyquarternium 10 and available from Amerchol Corp. (Edison, N.J., USA) in their Polymer LR, JR, and KG series of polymers. Other suitable types of cationic celluloses include the polymeric quaternary ammonium salts of hydroxyethyl cellulose reacted with lauryl dimethyl ammonium-substituted epoxide referred to in the industry (CTFA) as Polyquarternium 24. These materials are available from Amerchol Corp. under the tradename Polymer LM-200.

Other suitable cationic polymers include cationic guar gum derivatives, such as guar hydroxypropyltrimonium chloride, specific examples of which include the Jaguar series commercially available from Rhone-Poulenc Incorporated and the N-Hance series commercially available from Aqualon Division of Hercules, Inc. Other suitable cationic polymers include quaternary nitrogen-containing cellulose ethers, some examples of which are described in U.S. Pat. No. 3,962,418. Other suitable cationic polymers include copolymers of etherified cellulose, guar and starch, some examples of which are described in U.S. Pat. No. 3,958,581. When used, the cationic polymers herein are either soluble in the composition or are soluble in a complex coacervate phase in the composition formed by the cationic polymer and the anionic, amphoteric and/or zwitterionic surfactant component described hereinbefore. Complex coacervates of the cationic polymer can also be formed with other charged materials in the composition.

Techniques for analysis of formation of complex coacervates are known in the art. For example, microscopic analyses of the compositions, at any chosen stage of dilution, can be utilized to identify whether a coacervate phase has formed. Such coacervate phase will be identifiable as an additional emulsified phase in the composition. The use of dyes can aid in distinguishing the coacervate phase from other insoluble phases dispersed in the composition.

Most preferably the cationic non-silicone-containing polymer is of natural or synthetic origin and selected from the group consisting of substituted and unsubstituted polyquaternary ammonium compounds, cationically modified polysaccharides, cationically modified (meth)acrylamide polymers/copolymers, cationically modified (meth)acrylate polymers/copolymers, chitosan, quaternized vinylimidazole polymers/copolymers, dimethyldiallylammonium polymers/copolymers, and polyethylene imine based polymers, and derivatives thereof and mixtures thereof.

Reference is made to "Principles of Polymer Science and Technology in Cosmetics and Personal Care" by Goddard and Gruber and in particular to pages 260-261, where an additional list of suitable synthetic cationic polymers can be found.

D, Anionic Non-Silicone-containing Polymer—In general, anionic non-silicone-containing polymers of natural origin, but also of synthetic origin are suitable for incorporation in the compositions of the present invention. The anionic non-silicone-containing polymer is selected from the group consisting of xanthan gum, anionic starch, carboxymethyl guar, carboxymethyl hydroxypropyl guar, carboxy methyl cellulose, N-carboxyalkyl chitosan, N-carboxyalkyl chitosan amides, pectin, carrageenan gum, chondroitin sulfate, hyaluronic acid-, and alginic acid-based polymers, and derivatives thereof and mixtures thereof. More preferably, the anionic non-silicone-containing polymer is selected from carboxymethyl guar, carboxymethyl hydroxypropyl guar, carboxymethyl cellulose and xanthan gum, and derivatives and mixtures thereof. If present, the anionic non-silicone-containing polymer is typically present at levels in the range of from 0.01% to 10%, preferably at least from 0.05% to 5%, more preferably from 0.1% to 2.0% by weight of the composition. Most preferred anionic non-silicone-containing polymers are those commercially available from CPKelco, sold under the tradename of Kelzan® RD and from Aqualon, sold under the tradename of Galactosol® SP722S, Galactosol® 60H3FD, and Galactosol® 70H4FD.

Ratio by Weight Between the Silicone-Containing Polymer and Non-Silicone-Containing Polymer In two embodiments of the present invention, the compositions comprise a mixture of a silicone-containing polymer and a non-silicone containing polymer. In these cases, the ratio by weight of the silicone-containing polymer to the non-silicone-containing polymer is between 100:1 to 1:1, preferably between 50:1 to 5:1, and even more preferably between 30:1 and 10:1.

E, Coacervate Phase—The phrase "coacervate phase" includes all kinds of separated polymer phases known by the person skilled in the art such as disclosed in L. Piculell & B. Lindman, Adv. Colloid Interface Sci., 41 (1992) and in B. Jonsson, B. Lindman, K. Holmberg, & B. Kronberb, "Surfactants and Polymers In Aqueous Solution", John Wiley & Sons, 1998. The mechanism of coacervation and all its specific forms are fully described in "Interfacial Forces in Aqueous Media", C. J. van Oss, Marcel Dekker, 1994, pages 245 to 271. When using the phrase "coacervate phase", we usually refer to a term, which is occasionally expressed as "complex coacervate phase" or as "associated phase separation" in the literature.

Generally for the purpose of the present invention, the coacervate is formed by the anionic polymer and the cationic polymer. More complex coacervates can also be formed with other charged materials in the composition, i.e., in conjunction with anionic, cationic, zwitterionic and/or amphoteric surfactants and mixtures thereof.

Techniques for analysis of formation of coacervates are known in the art. For example, microscopic analyses of the compositions, at any chosen stage of dilution, can be utilized to identify whether a coacervate phase has formed. Such coacervate phase will be identifiable as an additional emulsified phase in the composition. The use of dyes can aid in distinguishing the coacervate phase from other insoluble phases dispersed in the composition.

When referring to the formation of a coacervate phase, it is meant and it is highly preferred that the coacervate phase is built upon dilution of the composition with a diluent during the laundry treatment application, e.g. during the wash cycle and/or during the rinse cycle. Also, when referring to the formation of a coacervate phase, it is meant that the coacervate phase can already be formed in the finished composition, although less preferred. If however, the coacervate phase is already built in the finished composition, it is highly preferred that the coacervate phase is suspended in a structured matrix.

F, Diluent—During the laundry treatment application, e.g. during the wash cycle and/or during the rinse cycle, the fabric treatment compositions of the present invention are typically diluted with a diluent, which is preferably an aqueous composition, more preferably water.

G, Surfactants—The present compositions may optionally comprise and preferably do comprise at least one surfactant selected from the group consisting of anionic, cationic, nonionic, zwitterionic and amphoteric surfactants and mixtures thereof. Suitable levels of this component are in the range from 0.0% to 80%, preferably from 5.0% to 65%, more preferably from 10% to 50% by weight of the composition.

(g1) Anionic Surfactants—The compositions of the invention comprise an anionic surfactant. By nature, every anionic surfactant known in the art of detergent compositions may be used, such as disclosed in "Surfactant Science Series", Vol. 7, edited by W. M. Linfield, Marcel Dekker. However, the compositions of the present invention comprise preferably at least a sulphonic acid surfactant, such as a linear alkyl benzene sulphonic acid, but water-soluble salt forms may also be used. Anionic surfactant(s) are typically present at a level of from 1.0% to 70%, preferably from 5.0% to 50% by weight, and more preferably from 10% to 30% by weight of the fabric treatment composition.

Anionic sulfonate or sulfonic acid surfactants suitable for use herein include the acid and salt forms of C5-C20, more preferably C10-C16, more preferably C11-C13 alkylbenzene sulfonates, C5-C20 alkyl ester sulfonates, C6-C22 primary or secondary alkane sulfonates, C5-C20 sulfonated polycarboxylic acids, and any mixtures thereof, but preferably C11-C13 alkylbenzene sulfonates.

Anionic sulphate salts or acids surfactants suitable for use in the compositions of the invention include the primary and secondary alkyl sulphates, having a linear or branched alkyl or alkenyl moiety having from 9 to 22 carbon atoms or more preferably 12 to 18 carbon atoms.

Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl ethyoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines such as Mono Ethanol Amine or Triethanolamine, and are fully soluble in the liquid phase.

(g2) Cationic nitrogen-containing surfactants—Cationic nitrogen-containing surfactants suitable for use in the compositions of the present invention have at least one quaternized nitrogen and one long-chain hydrocarbyl group. Compounds comprising two, three or even four long-chain hydrocarbyl groups are also included. Examples of such cationic surfactants include alkyltrimethylammonium salts or their hydroxyalkyl substituted analogs, preferably compounds having the formula $R_1R_2R_3R_4N^+X^-$. $R_1$, $R_2$, $R_3$ and $R_4$ are independently selected from $C_1$-$C_{26}$ alkyl, alkenyl, hydroxyalkyl, benzyl, alkylbenzyl, alkenylbenzyl, benzylalkyl, benzylalkenyl and X is an anion. The hydrocarbyl groups $R_1$, $R_2$, $R_3$ and $R_4$ can independently be alkoxylated, preferably ethoxylated or propoxylated, more preferably ethoxylated with groups of the general formula $(C_2H_4O)_xH$ where x has a value from 1 to 15, preferably from 2 to 5. Not more than one of $R_2$, $R_3$ or $R_4$ should be benzyl. The hydrocarbyl groups $R_1$, $R_2$, $R_3$ and $R_4$ can independently comprise one or more, preferably two, ester-([—O—C(O)—]; [—C(O)—O—]) and/or an amido-groups ([O—N(R)—]; [—N(R)—O—]) wherein R is defined as $R_1$ above. The anion X may be selected from halide, methylsulfate, acetate and phosphate, preferably from halide and methylsulfate, more preferably from chloride and bromide. The $R_1$, $R_2$, $R_3$ and $R_4$ hydrocarbyl chains can be fully saturated or unsaturated with varying Iodine value, preferably with an Iodine value of from 0 to 140. At least 50% of each long chain alkyl or alkenyl group is predominantly linear, but also branched and/or cyclic groups are included.

For cationic surfactants comprising only one long hydrocarbyl chain, the preferred alkyl chain length for $R_1$ is $C_{12}$-$C_{15}$ and preferred groups for $R_2$, $R_3$ and $R_4$ are methyl and hydroxyethyl.

For cationic surfactants comprising two or three or even four long hydrocarbyl chains, the preferred overall chain length is $C_{18}$, though mixtures of chainlengths having non-zero proportions of lower, e.g., $C_{12}$, $C_{14}$, $C_{16}$ and some higher, e.g., $C_{20}$ chains can be quite desirable.

Preferred ester-containing surfactants have the general formula $$\{(R_5)_2N((CH_2)_nER_6)_2\}^+X^-$$

wherein each $R_5$ group is independently selected from $C_{1-4}$ alkyl, hydroxyalkyl or $C_{2-4}$ alkenyl; and wherein each $R_6$ is independently selected from $C_{8-28}$ alkyl or alkenyl groups; E is an ester moiety i.e., —OC(O)— or —C(O)O—, n is an integer from 0 to 5, and $X^-$ is a suitable anion, for example chloride, methosulfate and mixtures thereof.

A second type of preferred ester-containing cationic surfactant can be represented by the formula: $\{(R_5)_3N(CH_2)_nCH(O(O)CR_6)CH_2O(O)CR_6\}^+X^-$ wherein $R_5$, $R_6$, X, and n are defined as above. This latter class can be exemplified by 1,2 bis[hardened tallowoyloxy]-3-trimethylammonium propane chloride.

The cationic surfactants, suitable for use in the compositions of the present invention can be either water-soluble, water-dispersable or water-insoluble.

(g3) Nonionic Surfactants—The present compositions may optionally comprise and preferably do comprise this type of surfactant. Suitable levels of this component are in the range from 0.0% to 80%, preferably from 0.1% to 50%, more preferably from 1% to 30% by weight of the composition. Essentially any alkoxylated nonionic surfactant, suitably one containing only carbon, hydrogen and oxygen can be included in the present compositions, although amidofunctional and other heteroatom-functional types can in general also be used. Ethoxylated, propoxylated, butoxylated or mixed alkoxylated, for example ethoxylated/propoxylated aliphatic or aromatic hydrocarbyl chain nonionic surfactants are preferred. Suitable hydrocarbyl moieties can contain from 6 to 22 carbon atoms and can be linear, branched, cycloaliphatic or aromatic and the nonionic surfactant can be derived from a primary or secondary alcohol.

Preferred alkoxylated surfactants can be selected from the classes of the nonionic condensates of ethoxylated and ethoxylated/propoxylated or propoxylated/ethoxylated linear or lightly branched monohydric aliphatic alcohols, which can be natural or synthetic. Alkylphenyl alkoxylates such as the nonylphenyl ethoxylates can also suitably be used.

Especially suitable as nonionic surfactant or cosurfactant are the condensation products of primary aliphatic alcohols with from 1 to 75 moles of $C_2$-$C_3$ alkylene oxide, more suitably 1 to 15 moles, preferably 1 to 11 moles. Particularly preferred are the condensation products of alcohols having an alkyl group containing from 8 to 20 carbon atoms with from 2 to 9 moles and in particular 3 or 5 moles, of ethylene oxide per mole of alcohol.

Suitable nonionic surfactants containing nitrogen as heteroatom include the polyhydroxy fatty amides having the structural formula $R^1CONR^2Z$ wherein $R^1$ is a $C_5$-$C_{31}$ hydrocarbyl, preferably straight-chain $C_7$-$C_{19}$ alkyl or alkenyl, more preferably straight-chain $C_{11}$-$C_{17}$ alkyl or alkenyl, or mixture thereof; $R^2$ is H, $C_{1-18}$, preferably $C_1$-$C_4$ hydrocarbyl, 2-hydroxyethyl, 2-hydroxypropyl, ethoxy, propoxy, or a mixture thereof, preferably $C_1$-$C_4$ alkyl, more preferably methyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar such as glucose, a corresponding preferred compound being a $C_{11}$-$C_{17}$ alkyl N-methyl glucamide.

Other nonionic surfactants useful herein include the so-called "capped" nonionics in which one or more —OH moieties are replaced by —OR wherein R is typically lower alkyl such as C1-C3 alkyl; the long-chain alkyl polysaccharides, more particularly the polyglycoside and/or oligosaccharide type, as well as nonionic surfactants derivable by esterifying fatty acids.

(g4) Amphoteric and Zwitterionic Surfactants: Suitable amphoteric or zwitterionic detersive surfactants for use in the composition herein include those which are known for use in hair care or other personal care cleansing. Concentration of such amphoteric detersive surfactants preferably ranges from 0.0% to 20%, preferably from 0.5% to 5%. Non-limiting examples of suitable zwitterionic or amphoteric surfactants are described in U.S. Pat. Nos. 5,104,646 (Bolich Jr. et al.), 5,106,609 (Bolich Jr. et al.).

Amphoteric detersive surfactants suitable for use in the composition are well known in the art, and include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include cocoamphoacetate, cocoamphodiacetate, lauroamphoacetate, lauroamphodiacetate, and mixtures thereof.

Zwitterionic detersive surfactants suitable for use in the compositions are well known in the art, and include those surfactants broadly described as derivatives of aliphatic quaternary ammonium, phosphonium, and sulfonium compounds, in which the aliphatic radicals can be straight or branched chain, and wherein one of the aliphatic substituents contains from 8 to 18 carbon atoms and one contains an anionic group such as carboxy, sulfonate, sulfate, phosphate or phosphonate. Zwitterionics such as betaines are suitable for this invention.

Furthermore, amine oxide surfactants having the formula: $R(EO)_x(PO)_y(BO)_zN(O)(CH_2R')_2.qH_2O$ (I) are also suitable for incorporation within the compositions of the present invention. R is a relatively long-chain hydrocarbyl moiety which can be saturated or unsaturated, linear or branched, and can contain from 8 to 20, referably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and U.S. Pat. Nos. 3,929,678, 2,658,072; 2,438,091; 2,528,378.

H, Laundry Adjunct Materials—

(a) Stabilizer—Compositions of the present invention may optionally comprise and preferably do comprise a stabilizer.

Suitable levels of this component are in the range from 0.0% to 20%, preferably from 0.1% to 10%, and even more preferably from 0.1% to 3% by weight of the composition. The stabilizer serves to stabilize the silicone polymer in the inventive compositions and to prevent it from coagulating and/or creaming. This is especially important when the inventive compositions have fluid form, as in the case of liquid or gel-form laundry detergents for heavy-duty or fine fabric wash use, and liquid or gel-form fabric treatments other than laundry detergents.

Stabilizers suitable for use herein can be selected from thickening stabilizers. These include gums and other similar polysaccharides, for example gellan gum, carrageenan gum, and other known types of thickeners and rheological additives other than highly polyanionic types; thus conventional clays are not included.

More preferably the stabilizer is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a nonlimiting example of a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the detergent out of a standard bottle, while the low shear viscosity of the product at 0.1 $s^{-1}$ can be at least 0.002 $m^2/s$ (2,000 centistokes at 20° C.) but more preferably greater than 0.02 $m^2/s$ (20,000 centistokes at 20° C.). A process for the preparation of a thread-like structuring system is disclosed in WO 02/18528.

Other less preferred stabilizers are uncharged, neutral polysaccharides, gums, celluloses, and polymers like polyvinyl alcohol.

(b) Coupling agent—Coupling agents suitable for use herein include fatty amines other than those which have marked surfactant character or are conventional solvents (such as the lower alkanolamines). Examples of these coupling agents include hexylamine, octylamine, nonylamine and their C1-C3 secondary and tertiary analogs. Levels of this component, when present, are suitably in the range of from 0.1% to 20%, more typically 0.5% to 5% by weight of the composition.

A particularly useful group of coupling agents is selected from the group consisting of molecules which consist of two polar groups separated from each other by at least 5, preferably 6, aliphatic carbon atoms; preferred compounds in this group are free from nitrogen and include 1,4 Cyclo Hexane Di Methanol (CHDM), 1,6 Hexanediol, 1,7 Heptanediol and mixtures thereof. 1,4 Cyclo Hexane Di Methanol may be present in either its cis configuration, its trans configuration or a mixture of both configurations.

(c) Detergent builder—The compositions of the present invention may optionally comprise a builder, at levels of from 0.0% to 80% by weight, preferably from 5% to 70% by weight, more preferably from 20% to 60% by weight of the composition.

In general any known detergent builder is useful herein, including inorganic types such as zeolites, layer silicates, fatty acids and phosphates such as the alkali metal polyphosphates, and organic types including especially the alkali metal salts of citrate, 2,2-oxydisuccinate, carboxymethyloxysuccinate, nitrilotriacetate and the like. Phosphate-free, water-soluble organic builders which have relatively low molecular weight, e.g., below 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical.

Preferred are in particular $C_{12}$-$C_{18}$ saturated and/or unsaturated, linear and/or branched, fatty acids, but preferably mixtures of such fatty acids. Highly preferred have been found mixtures of saturated and unsaturated fatty acids, for example preferred is a mixture of rape seed-derived fatty acid and $C_{16}$-$C_{18}$ topped whole cut fatty acids, or a mixture of rape seed-derived fatty acid and a tallow alcohol derived fatty acid, palmitic, oleic, fatty alkylsuccinic acids, and mixtures thereof. Further preferred are branched fatty acids of synthetic or natural origin, especially biodegradable branched types.

While the term "fatty acid builder" is in common use, it should be understood and appreciated that as formulated in the present detergents, the fatty acid is in at least partially neutralized to neutralized form, the counter-ions can typically be alkanolamines, sodium, potassium, alkanolammonium or mixtures thereof. Preferably, the fatty acids are neutralized with alkanolamines such as Mono Ethanol Amine, and are fully soluble in the liquid phase.

(d) Fabric substantive perfume—The fabric treatment compositions of the present invention can comprise perfume to provide a "scent signal" in the form of a pleasant odor which provides a freshness impression to the fabrics. The fabric substantive perfume ingredients are suitably at levels in the range from 0.0001% to 10% by weight of the composition and are characterized by their boiling points (B.P.). The fabric substantive perfume ingredients have a B.P, measured at the normal, standard pressure of 760 mm Hg, of 240° C. or higher, and preferably of 250° C. or higher. Preferably the fabric substantive perfume ingredients have a ClogP of greater than 3, more preferably from 3 to 6.

The preferred compositions used in the present invention contain at least 2, preferably at least 3, more preferably at least 4, even more preferably at least 5, even more preferably at least 6, and even more preferably at least 7 different fabric substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

Nonlimiting examples of suitable fabric substantive perfume ingredients for use in the compositions of the present invention are disclosed in WO 02/18528.

(e) Enzyme—Suitable enzymes for use herein include protease, amylase, cellulase, mannanase, endoglucanase, lipase and mixtures thereof. Enzymes can be used at their art-taught levels, for example at levels recommended by suppliers such as Novo and Genencor. Preferred levels in the compositions are from 0% to 5%, more preferably from 0.0001% to 5% by weight of the composition. When enzymes are present, they can be used at very low levels, e.g., from 0.001% or lower, in certain embodiments of the invention; or they can be used in heavier-duty laundry detergent formulations in accordance with the invention at higher levels, e.g., 0.1% and higher. In accordance with a preference of some consumers for "non-biological" detergents, the present invention includes both enzyme-containing and enzyme-free embodiments.

(f) Chelating agent—Suitable chelating agents for use herein include nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelating agents such as compounds of the general class of certain macrocyclic N-ligands such as those known for use in bleach catalyst systems. Levels of chelating agents are typically lower than 5%, more typically, chelating agents, when present, are at levels of from 0.01% to 3%.

(g) Effervescent system—Effervescent systems suitable herein include those derived by combining an acid and a bicarbonate or carbonate, or by combining hydrogen peroxide and catalase, or any other combination of materials which release small bubbles of gas. The components of the effervescent system may be may be dispensed in combination to form the effervescence when they are mixed, or can be formulated together provided that conventional coatings or protection systems are used. Levels of effervescent system can vary very widely, for example effervescent components together can range from 0.1% to 30% of the composition. Hydrogen peroxide and catalase are very mass efficient and can be at much lower levels with excellent results.

(h) Suds Suppressing system—Suitable suds suppressing systems for use herein may comprise essentially any known antifoam compound or mixture, typically at a level less than 10%, preferably 0.001% to 10%, preferably from 0.01% to 8%, most preferably from 0.05% to 5%, by weight of the composition. Suitable suds suppressors can include low solubility components such as highly crystalline waxes and/or hydrogenated fatty acids, silicones, silicone/silica mixtures, or more sophisticated compounded suds suppressor combinations, for example those commercially available from companies such as Dow Corning. Compounded silicones are suitably used at levels of 0.005% to 0.5% by weight. More soluble antifoams include for example the lower 2-alkyl alkanols such as 2-methyl-butanol.

(i) Liquid Carrier—In case the fabric treatment composition of the present invention is a liquid composition, the compositions can comprise a liquid carrier. The liquid carrier can be aqueous or non-aqueous; and can include water alone or organic solvents alone and/or mixtures thereof. Preferred organic solvents include monohydric alcohols, dihydric alcohols, polyhydric alcohols, glycerol, glycols, polyalkylene glycols such as polyethylene glycol, and mixtures thereof. Highly preferred are mixtures of solvents, especially mixtures of lower aliphatic alcohols such as ethanol, propanol, butanol, isopropanol, and/or diols such as 1,2-propanediol or 1,3-propanediol; or mixtures thereof with glycerol. Suitable alcohols especially include a $C_1$-$C_4$ alcohol. Preferred is 1,2-propanediol. The liquid carrier is typically present at levels in the range of from 0.0% to 98%, preferably at least from 10% to 95%, more preferably from 25% to 75% by weight of the composition.

(j) Amino Silicone—Herein "aminosilicone" means any amine functionalized silicone; i.e., a silicone containing at least one primary amine, secondary amine, or tertiary amine. Preferred aminosilicones will typically have between 0.01% to 1% nitrogen, and more preferably between 0.05% to 0.5% nitrogen by weight of the aminosilicone. If present, the amino silicone polymer is typically present at levels in the range of from 0.001% to 50%, preferably at least from 0.01% to 30%, more preferably from 0.1% to 10%, and most preferably from 0.2% to 5.0% by weight of the composition.

Typically, the aminosilicone has a viscosity of from 0.001 $m^2/s$ (1,000 centistokes at 20° C.) to 0.05 $m^2/s$ (50,000 centistokes at 20° C.), more preferably 0.002 $m^2/s$ (2,000 centistokes at 20° C.) to 0.03 $m^2/s$ (30,000 centistokes at 20° C.), more preferably from 0.004 $m^2/s$ (4,000 centistokes at 20° C.) to 0.02 $m^2/s$ (20,000 centistokes at 20° C.).

Example preferred aminosilicones for use in the compositions of the present invention include but are not limited to, those which conform to the general formula (V):

$$(R_1)_aG_{3-a}\text{-Si}—(—OSiG_2)_n\text{-}(—OSiG_b(R_1)_{2-b})_m—OSiG_{3-a}(R_1)_a$$

wherein G is hydrogen, phenyl, hydroxy, or $C_1$-$C_8$ alkyl, preferably methyl; a is 0 or an integer having a value from 1 to 3, preferably 1; b is 0, 1 or 2, preferably 1; n is a number from 0 to 1,999, preferably from 49 to 500; m is an integer from 1 to 2,000, preferably from 1 to 10; the sum of n and m is a number from 1 to 2,000, preferably from 50 to 500; $R_1$ is a monovalent radical conforming to the general formula $C_qH_{2q}L$, wherein q is an integer having a value from 2 to 8 and L is selected from the following groups: $—N(R_2)CH_2—CH_2—N(R_2)_2$; $—(R_2)_2$; wherein $R_2$ is hydrogen, phenyl, benzyl, or a saturated hydrocarbon radical, preferably an alkyl radical from $C_1$ to $C_{20}$.

A preferred aminosilicone corresponding to formula (V) is the shown below in formula (VI):

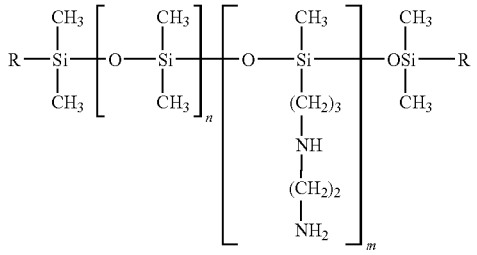

wherein R is independently selected from C1 to C4 alkyl, alkoxy, hydroxyalkyl and mixtures thereof, preferably from methyl and methoxy. When both R groups are methyl, the above polymer is known as "trimethylsilylamodimethicone".

Most preferred amino silicones are those commercially available from Wacker, sold under the tradename of Wacker Belsil® ADM 1100 and Wacker Finish® WR 1100, and from General Electric sold as General Electric® SF 1923.

(j) Nitrogen-free Silicone Polymer—Suitable levels of this component are in the range from 0.0% to 90%, preferably from 0.01% to 50%, more preferably from 0.1% to 10%, and most preferably from 0.5% to 5.0% by weight of the composition.

The nitrogen-free silicone polymer selected for use in the compositions of the present inventions includes nonionic, zwitterionic and amphoteric nitrogen-free silicone polymers.

Preferably, the nitrogen-free silicone polymer is selected from nonionic nitrogen-free silicone polymers having the formulae (I) to (III):

(I)

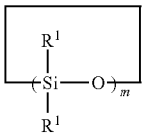

(II)

$$R^2—(R^1)_2SiO—[(R^1)_2SiO]_a—[(R^1)(R^2)SiO]_b—Si(R^1)_2—R^2$$

(III)

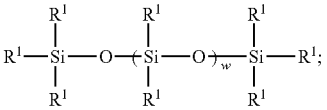

and mixtures thereof, wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and mixtures thereof; each $R^2$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and from a poly(ethyleneoxide/propyleneoxide) copolymer group having the general formula (IV):

$$—(CH_2)_nO(C_2H_4O)_c(C_3H_6O)_dR^3 \quad (IV)$$

with at least one $R^2$ being a poly(ethyleneoxy/propyleneoxy) copolymer group, and each $R^3$ is independently selected from the group consisting of hydrogen, an alkyl having 1 to 4 carbon atoms, and an acetyl group, wherein the index w has the value as such that the viscosity of the nitrogen-free silicone polymer of formulae (I) and (III) is between $2\cdot10^{-6}$ $m^2/s$ (2 centistokes at 20° C.) and 50 $m^2/s$ (50,000,000 centistokes at 20° C.); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from linear nonionic nitrogen-free silicone polymers having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above and wherein the index w has the value as such that the viscosity of the nitrogen-free silicone polymer of formula (III) is between 0.01 $m^2/s$ (10,000 centistokes at 20° C.) and 0.8 $m^2/s$ (800,000 centistokes at 20° C.); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from linear nonionic nitrogen-free silicone polymers having the formula (III) as above, wherein $R^1$ is methyl and wherein the index w has the value as such that the viscosity of the nitrogen-free silicone polymer of formula (III) is between 0.06 $m^2/s$ (60,000 centistokes at 20° C.) and 0.7 $m^2/s$ (700,000 centistokes at 20° C.) and more preferably between 0.1 $m^2/s$ (100,000 centistokes at 20° C.) and 0.48 $m^2/s$ (480,000 centistokes at 20° C.), and mixtures thereof.

Nonlimiting examples of nitrogen-free silicone polymers of fomula (II) are the Silwete® compounds which are available from OSI Specialties Inc., a Division of Witco, Danbury, Conn. Nonlimiting examples of nitrogen-free silicone polymers of formula (I) and (III) are the Silicone 200 fluid series from Dow Corning.

(k) Other adjuncts—Examples of other suitable cleaning adjunct materials include, but are not limited to, fatty acids, alkoxylated benzoic acids or salts thereof such as trimethoxy benzoic acid or a salt thereof (TMBA), conventional (not fabric substantive) perfumes and pro-perfumes, zwitterionic and/or amphoteric surfactants, bleaches, bleach activators, bleach catalysts, enzyme stabilizing systems, optical brighteners or fluorescers, soil release polymers, dispersants or polymeric organic builders including water-soluble polyacrylates, acrylate/maleate copolymers and the like, suds suppressors, dyes, colorants, filler salts such as sodium sulfate, hydrotropes such as toluenesulfonates, cumenesulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464, 5,710,115, 5,698,504, 5,695,679, 5,686,014 and 5,646,101.

Process for preparing the fabric treatment composition—The fabric treatment compositions of the present invention can be prepared in any suitable manner and can, in general, involve any order of mixing or addition.

This process for preparing the fabric treatment composition of the present invention is preferably carried out using conventional high-shear mixing means. This ensures proper dispersion of the ingredients throughout the final composition.

Liquid compositions, especially liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition. When such a stabilizer premix is used, it is preferably added into the composition after addition of the oppositely charged polymers.

Forms and types of the Compositions—The fabric treatment composition of the present invention may be in any form, such as liquids (aqueous or non-aqueous), granules, pastes, powders, sprays, foams, tablets, and gels. Unitized dose compositions are included, as are compositions, which form two or more separate but combined dispensable portions. Granular compositions can be in "compact" or "low density" form and the liquid compositions can also be in a "concentrated" or diluted form. Preferred fabric treatment compositions of the present invention include liquids, more preferably heavy duty liquid fabric treatment compositions and liquid laundry detergents for washing 'standard', non-fine fabrics as well as fine fabrics including silk, wool and the like. Compositions formed by mixing the provided compositions with water in widely ranging proportions are included.

The fabric treatment composition of the present invention may also be present in form of a rinse-added composition for delivering fabric care benefits, e.g., in form of a rinse-added fabric-softening composition, or in form of a fabric finishing composition, or in form of a wrinkle-reduction composition.

The fabric treatment compositions of the present invention may be in the form of spray compositions, preferably contained within a suitable spray dispenser. The present invention also includes products in a wide range of types such as single-phase compositions, as well as dual-phase or even multi-phase compositions. The fabric treatment compositions of the present invention may be incorporated and stored in a single-, dual-, or multi-compartment bottle.

Method of Treating Fabrics and Uses of Compositions of the Invention in Relation to Form—

The term "substrate" as used herein means a substrate comprising natural and/or synthetic fibers or fabrics, especially a fabric or garment, having one or more of the fabric care benefits described herein as imparted thereto by any of the compositions of the present invention.

A method of treating a substrate comprising the steps of contacting the substrate with the fabric treatment composition of the present invention is incorporated in the present invention. As used herein, "fabric treatment compositions" include fabric treatment compositions for handwash, machine wash and other purposes including fabric care additive compositions and compositions suitable for use in the soaking and/or pretreatment of stained fabrics.

Even though fabric treatment compositions are specifically discussed herein, compositions of the present invention comprising at least one cationic polymer and at least one anionic polymer, wherein at least one of these two polymers is a silicone polymer, and wherein the composition forms a coacervate phase upon dilution of the composition with a liquid carrier without adding further surfactant for use in treating, cleaning, conditioning, and/or refreshing both natural and synthetic fibers are encompassed by the present invention.

EXAMPLES

The following non-limiting examples are illustrative of the present invention. Percentages are by weight unless otherwise specified.

Example 1

The final fabric treatment composition is formulated by combining two distinctive premixes: a fabric cleaning premix A according to formula A1 as below and a fabric care premix B as below.

Fabric Cleaning Premix A:

| Formula A1: | Wt % (raw materials at 100% activity) |
|---|---|
| C13–15 alkylbenzene sulphonic acid | 13.0 |
| C14–15 EO8 (1) | 9.0 |
| C12–14 alkyl dimethyl amineoxide (2) | 1.5 |
| C12–18 fatty acid | 10.0 |
| Citric acid | 4.0 |
| Diethylene triamine pentamethylene phosphonic acid | 0.3 |
| Hydroxyethane dimethylene phosphonic acid | 0.1 |
| Ethoxylated polyethylene imine | 1.0 |
| Ethoxylated tetraethylene pentamine | 1.0 |
| Fluorescent whitening agent | 0.15 |

-continued

| Formula A1: | Wt % (raw materials at 100% activity) |
|---|---|
| $CaCl_2$ | 0.02 |
| Propanediol | 5.0 |
| Ethanol | 2.0 |
| Sodium cumene sulphonate | 2.0 |
| NaOH | to pH 7.5 |
| Protease enzyme | 0.75 |
| Amylase enzyme | 0.20 |
| Cellulase enzyme | 0.05 |
| Hydrogenated castor oil | 0.2 |
| Dye | 0.001 |
| Perfume | 0.70 |
| Water | Balance |

(1) Marlipal 1415/8.1 ex Sasol (2) C12–14 alkyl dimethyl amineoxide ex P&G, supplied as a 31% active solution in water The preparation of Fabric Care premix B is divided into three steps:

1. Preparation of a cationic guar gum premix (premix B1): Premix B1 is made by mixing 5.0 g cationic guar gum (3) in 495 g demineralized water with a normal laboratory blade mixer (type: Janke & Kunkel, IKA-Labortechnik RW 20). The mixture is stirred for 20 minutes.
2. Preparation of an anionic silicone emulsion (premix B2): Premix B2 is made by adjusting the pH of 27.4 g anionic silicone emulsion (4) with 2.8 g of HCl 1M to pH 7.8-8.0.
3. Combination of the two premixes B1 and B2: 37.5 g of Premix B1 is added to 30.2 g of premix B2. The mixture is stirred for 15 minutes with a normal laboratory blade mixer.

The final fabric treatment composition is formulated by adding 13.6 g of premix B (combined premixes B1 and B2) to 100 g of premix A by using a normal laboratory blade mixer.

(3) Cationic guar gum: Galactosol SP813S ex Aqualon (4) Anionic silicone emulsion: Densodrin OF ex BASF (18.2% active material)

Example 2

The preparation is divided into three steps:

1. Preparation of a cationic guar gum premix (premix C): premix C is made by mixing 5.0 g cationic guar gum (3) with 495 g demineralized water using a normal laboratory blade mixer. The mixture is stirred for 20 minutes.
2. Preparation of an anionic silicone emulsion (premix D): premix D is made by adjusting the pH of 82.4 g anionic silicone emulsion (4) with 8.8 g of HCl 1M to pH 7.8-8.0.
3. Combination of the two premixes C and D: 75.0 g of premix C is added to 91.2 g of premix D. The mixture is stirred for 15 minutes with a normal laboratory blade mixer.

33.3 g of this combined premixes C and D is used as a rinse added fabric treatment composition.

Example 3

The preparation is divided into three steps:

1. Preparation of an anionic guar gum premix (premix E): premix E is prepared by mixing 15 g of anionic guar gum (Galactosol SP722S ex Hercules/Aqualon) with 1485 g demineralized water using a normal lab blade mixer. The mixture is stirred for 30 min until full viscosity development.
2. Preparation of an cationic silicone emulsion (premix F): premix F is prepared by mixing 24.39 g of cationic silicone solution (5) with 6.05 g C12-15 EO3 (6) with a normal laboratory blade mixer. After 10 minutes, 6.7 g of ethanol is added. After another 10 minutes, 8.71 g of C12-14 alkyl dimethyl amineoxide 31% active solution in water (2) is added. After another 10 minutes, 54.2 g of demineralized water are quickly added to the mixture, under continuous stirring. The pH of the premix is brought to pH 7.5 with 0.8 g 0.1M HCl.

3. Combination of the two premixes E and F: To formulate the final rinse added fabric care composition, 100 g of premix E is added to 75 g of premix F, under continuous stirring with a normal lab blade mixer.

17.5 g of these combined premixes are used as a rinse added fabric care composition.

(5) Cationic silicone structure as in structure 2b: (i) with: $R^1$, $R^3$=$CH_3$, $R^2$=$(CH_2)_3$, X=$CH_2CHOHCH_2$, a=0; b=1; c=150; d=0; cationic divalent moiety: ii(a) with $R^4$, $R^5$, $R^6$, $R^7$ all $CH_3$ and $Z^1$ is $(CH_2)_6$. A=50% by mole of acetate, 50% by mole of laurate, m=2; polyalkyleneoxide amine moiety (iii) is —$NHCH(CH_3)CH_2$—$[OCH(CH_3)CH_2]_r$—$[OCH_2CH_2]_{38.7}$—$[OCH_2CH(CH_3)]_z$—NH— with r+z=6.0; cationic monovalent moiety iv(i) has $R^{12}$, $R^{13}$ and $R^{14}$ all methyl. The mole fractions of the cationic divalent moiety (ii) of the polyalkyleneoxide amine moiety (iii) and of the cationic monovalent amine moiety (iv) are respectively 0.8, 0.1 and 0.1 expressed as fractions of the total moles of the organosilicone-free moieties. The cationic silicone is present as a 82 wt.-% solution in ethanol.

(6) Neodol 25-3 ex Shell Chemicals.

Example 4

The preparation is divided into three steps:

1. Preparation of an anionic silicone emulsion (premix G): premix G is made by adjusting the pH of 27.4 g anionic silicone emulsion (4) with 2.8 g of HCl 1M to pH 7.8-8.0.
2. Preparation of an cationic silicone emulsion (premix H): premix H is prepared by mixing 24.39 g of cationic silicone solution (5) with 6.05 g C12-15 EO3 (6) with a normal laboratory blade mixer. After 10 minutes, 6.7 g of ethanol is added. After another 10 minutes, 8.71 g of C12-14 alkyl dimethyl amineoxide 31% active solution in water (2) is added. After another 10 minutes, 54.2 g of demineralized water are quickly added to the mixture, under continuous stirring. The pH of the premix is brought to pH 7.5 with 0.8 g 0.1M HCl.
3. Combination of the two premixes G and H: To formulate the final rinse added fabric care composition, 100 g of premix G is added to 75 g of premix H, under continuous stirring with a normal lab blade mixer.

17.5 g of these combined premixes are used as a rinse added fabric care composition.

What is claimed is:

1. A fabric treatment composition comprising at least one cationic polymer and at least one anionic polymer, wherein said cationic polymer is a cationic silicone polymer and said anionic polymer is a non-silicone-containing polymer, said composition forms a coacervate phase and:

A. said cationic silicone polymer is composed of alternating units of:

(i) a polysiloxane of the following formula:

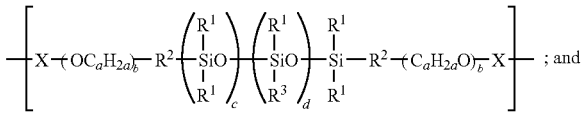

; and (ii) a cationic divalent organic moiety selected from the group consisting of:

(a) 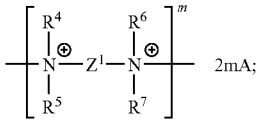 2mA;

(b) 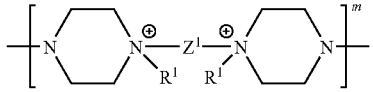 2mA;

(c) 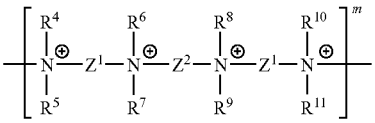 4mA;

(d) a divalent aromatic or aliphatic heterocyclic group, substituted or unsubstituted, containing at least one quarternized nitrogent atom; and mixtures thereof;

wherein $R^1$ is independently selected from the group consisting of $C_{1-22}$ alkyl, $C_{2-22}$ alkenyl, $C_{6-22}$ alkylaryl, aryl, cycloalkyl, and mixtures thereof;

$R^2$ is independently selected from the group consisting of divalent organic moieties;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

$R^4$, $R^5$, $R^6$, $R^7$, $R^8$, $R^9$, $R^{10}$, $R^{11}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; or in which $R^4$ and $R^6$, or $R^5$ and $R^7$, or $R^8$ and $R^{10}$, or $R^9$ and $R^{11}$ are components of a bridging alkylene group;

$Z^1$ and $Z^2$ are the same or different divalent hydrocarbon groups each comprising at least about 2 carbon atoms;

a is from about 2 to about 4; b is from 0 to about 100; c is from about 1 to about 1000; d is from 0 to about 100;

m is the number of positive charges associated with the cationic divalent organic moiety, which is greater than or equal to about 2; A is an anion; and wherein, expressed as fractions on the total moles of the organosilicone-free moieties, the cationic divalent organic moiety (ii) is present at of from about 0.05 to about 1.0 mole fraction; and said cationic silicone polymer further comprises a polyalkyleneoxide amine of formula:

$$[—Y—O(—C_aH_{2a}O)_b—Y—]$$

wherein Y is a divalent organic group comprising a secondary or tertiary amine; a is from about 2 to about 4 and b is from 0 to about 100, and the polyalkyleneoxide amine is present of from 0.0 to about 0.95 mole fraction;

B. said anionic polymer is selected from the group consisting of: anionic starch, carboxy methyl guar, carboxy methyl hydroxypropyl guar, N-carboxyalkyl chitosan, N-carboxyalkyl chitosan amides, pectin, chondroitin sulfate, alginic acid-based polymers; derivatives thereof, and mixtures thereof;

wherein the ratio by weight of said cationic silicone polymer to said anionic polymer is between 30:1 and 10:1.

2. A fabric treatment composition according to claim 1 wherein the cationic silicone further comprises an end-group cationic monovalent organic moiety selected from the group consisting of:

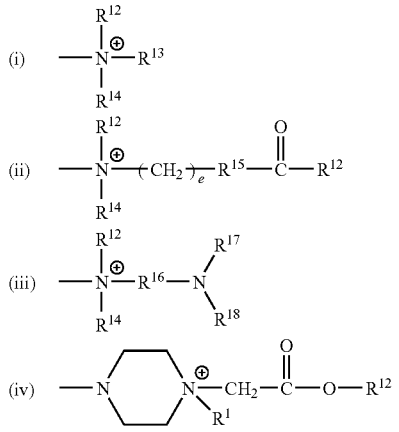

(v) monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, $C_{1-22}$ hydroxyalkyl, polyalkyleneoxide, (poly)alkoxy alkyl groups, and mixtures thereof;

$R^{15}$ is —O— or $NR^{19}$;

$R^{16}$ is divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; e is from about 1 to about 6, and the cationic monovalent organic moiety is present of from 0 to about 0.2 mole fraction.

3. A fabric treatment composition according to claim 1 wherein the cationic silicone further comprises an end-group cationic monovalent organic moiety selected from the group consisting of:

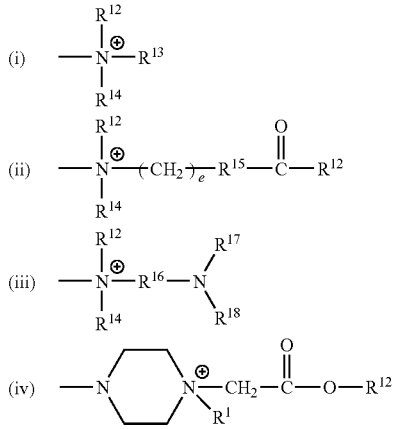

(v) monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, $C_{1-22}$ hydroxyalkyl, polyalkyleneoxide, (poly)alkoxy alkyl groups, and mixtures thereof;

$R^{15}$ is —O— or $NR^{19}$;

$R^{16}$ is divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof; e is from about 1 to about 6, and the cationic monovalent organic moiety is present of from 0 to about 0.2 mole fraction.

4. A fabric treatment composition according to claim 1 further comprising a surfactant selected from the group consisting of anionic surfactants, cationic surfactants, nonionic surfactants, zwitterionic surfactants, amphoteric surfactants, and mixtures thereof.

* * * * *

UNITED STATES PATENT AND TRADEMARK OFFICE

CERTIFICATE OF CORRECTION

PATENT NO. : 7,737,105 B2
APPLICATION NO. : 11/716962
DATED : June 15, 2010
INVENTOR(S) : Delplancke et al.

It is certified that error appears in the above-identified patent and that said Letters Patent is hereby corrected as shown below:

Column 16

Line 52, delete "referably" and insert --preferably--.

Column 22

Line 4, delete "Silwete®" and insert --Silwet®--.

Signed and Sealed this
Twenty-first Day of June, 2011

David J. Kappos

David J. Kappos
*Director of the United States Patent and Trademark Office*